United States Patent [19]

Bingen et al.

[11] 4,238,637

[45] Dec. 9, 1980

[54] CORELESS INDUCTION FURNACE

[76] Inventors: Roald Bingen, Avenue des Genéts, B-6001 Marcinelle; Jean-Pierre Cordier, Rue Place, 76, B-6110 Montigny-le-Tilleul; Raymond Georges, Rue d'Affnay, 7, B-4610 Beyne-Heusay, all of Belgium

[21] Appl. No.: 927,914

[22] Filed: Jul. 25, 1978

[30] Foreign Application Priority Data

Jul. 27, 1977 [BE] Belgium ..... 18300

[51] Int. Cl.[3] ..... H05B 5/00

[52] U.S. Cl. ..... 13/26

[58] Field of Search ..... 13/26, 27

[56] References Cited

U.S. PATENT DOCUMENTS 3,478,156 11/1969 Segsworth ..... 13/27

*Primary Examiner*—Roy N. Envall, Jr.

*Attorney, Agent, or Firm*—Schwartz, Jeffery, Schwaab, Mack, Blumenthal & Koch

[57] ABSTRACT

An apparatus and method for reducing surface perturbations of a molten metal in an inductive furnace wherein the molten metal is contained in a crucible surrounded by two groups of coils, each connected to a polyphase system of voltages. In the first group of coils, the inverse component of the voltages are negligible with respect to the direct components and the ratio of the homopolar component to the direct component is selected so that the tangential components of the vortices generated by the homopolar and direct components have opposing signs and amplitudes of the same order of magnitude. In the second group of coils, the voltages have a direct component negligible with respect to the inverse components and the ratio of the homopolar component to the inverse component is selected so that the tangential components of the vortices generated by the homopolar and inverse components have opposing signs and amplitudes of the same order of magnitude.

14 Claims, 19 Drawing Figures

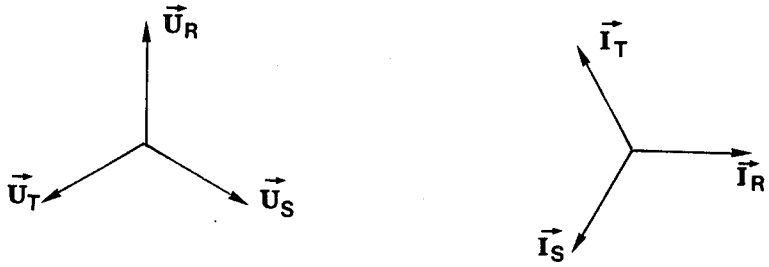
Fig. 3
Fig. 4
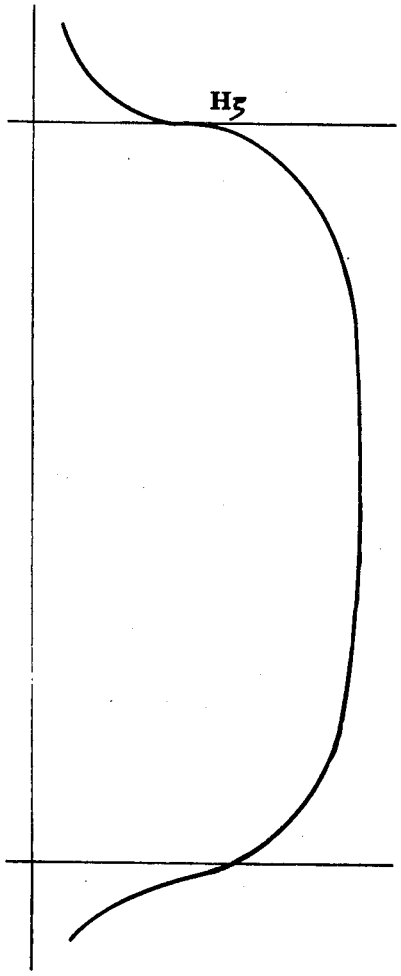
Fig. 5
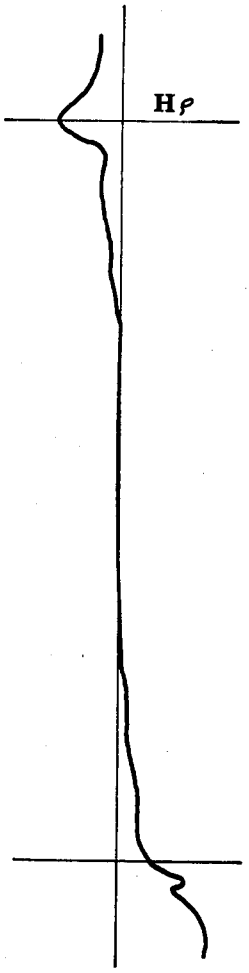
Fig. 6
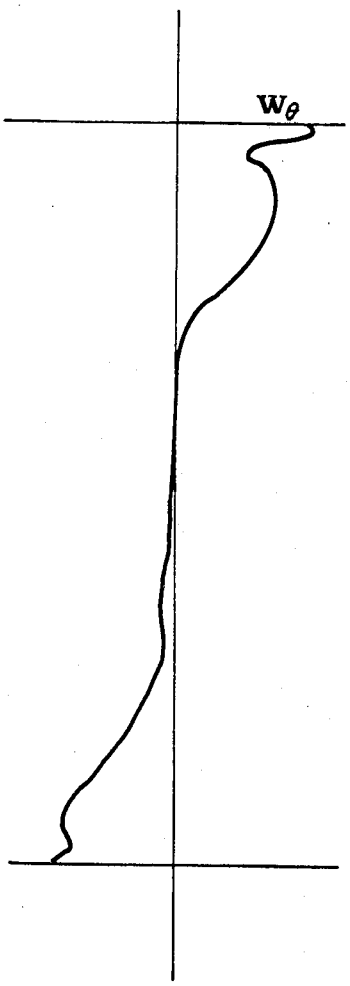

CORELESS INDUCTION FURNACE

In the manufacture of known coreless induction furnaces, two techniques are used concerning the coils which must induce the magnetic field within the crucible. Induction furnaces are produced with single phase coils which induce a stationary alternating field on the one hand, and polyphase coils inducing a progressive field, on the other hand.

BRIEF DESCRIPTION OF THE DRAWINGS

A more detailed description of the state on the known art is given hereinafter with reference to FIGS. 1 to 6 of the drawings attached hereto.

FIG. 3 is a series of vector diagrams;

FIGS. 4–6 are diagrams of physical values as a function of the height of the bath in the furnace;

Figure 1:
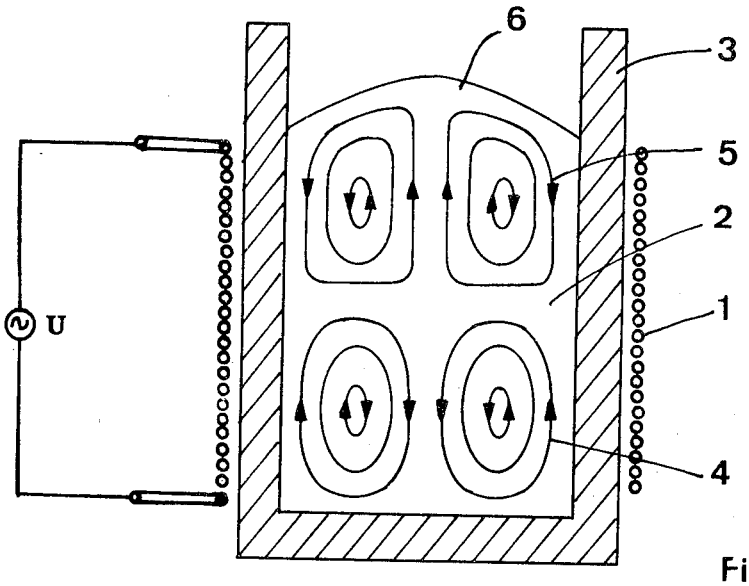
FIGS. 1 and 2 are schematic sections of an induction furnace.

In the induction furnace with stationary single phase coils, FIG. 1, a coil 1 with one winding is traversed by an alternating current of a frequency determined by the source of power. The alternating current inside the coil causes the appearance of induced currents in the bath 2 contained in the crucible 3. If the furnace is of cylindrical symmmetry, the magnetic field is axial in a first approximation, i.e. its axial component $H_\zeta$ is predominate. Nevertheless, in the upper and lower parts of the charge (FIG. 1), the magnetic field has a non-negligible radial component $\vec{H}_\rho$. It is known that this component $\vec{H}_\rho$ causes the appearance of turbulence within the metal in the molten state in the crucible. In fact, the simultaneous presence at one point of the molten metal of an induced current density represented by a vector $\vec{J}$ and of a magnetic field represented by a vector $\vec{H}$ (the conjugate of this vector is designated by $\vec{H}^*$ hereinafter), causes the appearance of a volume force $\vec{F}$ described by:

$$\vec{F}=\mu Re\{\vec{J}\times\vec{H}^*\}$$

where $\mu$ is the magnetic permeability and Re $(\vec{J}\times\vec{H}^*)$ is the real part of the vector $(\vec{J}\times\vec{H}^*)$.

The volume force $\vec{F}$ is rotational and the intensity of its turbulence represented by the vector $\vec{W}$ is:

$$\vec{W}=rot\,\vec{F}=\frac{2\mu}{r}Re\{J_\theta H_\rho^*\}+ j2\mu^2\omega\sigma(H_\xi^* H_\rho-H_\xi H_\rho^*) \quad (1)$$

In this equation, the indices $\rho$, $\theta$, $\zeta$ represent the radial, tangential and axial components of a vector, r the radius of the bath $\omega$ the frequency and $\sigma$ the electrical conductivity of the molten metal.

It is known that in single phase coil induction furnaces, such as the one shown in FIG. 1, $\vec{W}$ is zero or weak at the midheight of the molten bath and its tangential component $W_\theta$ (which is the only one different from zero) increases toward the lower and upper end of the bath, with a different sign in each of the halves. The sign is different, because in the case of single phase coils $H^*$ has opposing signs in the two halves and the first term of equation (1) is preponderant with respect to the second. These conditions are shown in the diagrams of FIGS. 4 to 6. The diagrams indicate, as functions of the height of the bath 2 in the crucible 3, the component $H_\zeta$ (FIG. 4), the component $H_\rho$ (FIG. 5) and the component $W_\theta$ calculated by equation (1), such as they are determined in a practical case and drawn on a given scale. It follows that two vortices 4 and 5 of opposing signs appear in the bath 2, one in the lower part, the other in the upper part. The vortex in the upper part causes the appearance of a bulge 6 on the surface of the bath.

Figure 2:
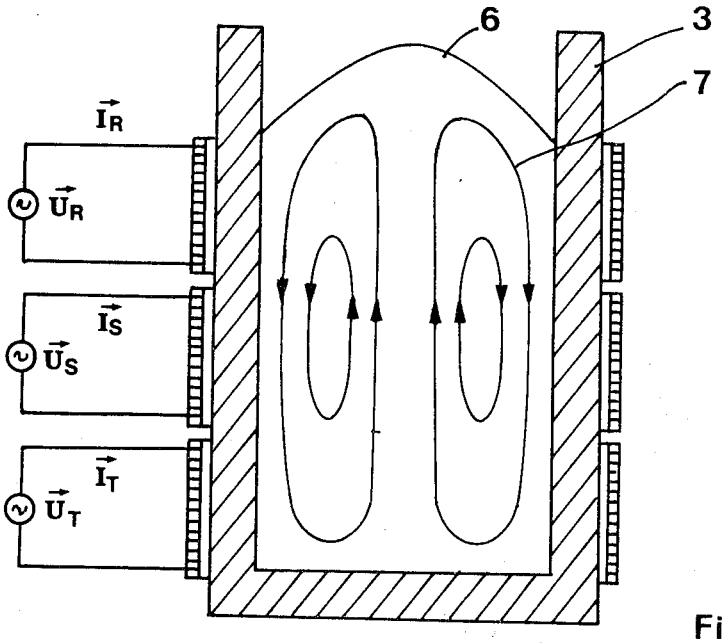

In the induction furnaces using a three phase coil with a progressing field, three coils (FIG. 2) are connected for example with a triphase system of $\vec{U}_R$, $\vec{U}_S$, and $\vec{U}_T$ (FIG. 3) and traversed by the currents $\vec{I}_S$, $\vec{I}_R$ and $\vec{I}_T$, out of phase by 120° with respect to each other. It is already known, for example by the French Pat. No. 1,240,309, to provide a progressive field by means of a system of voltages and currents out of phase by 60° with respect to each other. These currents develop a magnetic field which depends on the geometric disposition of the coils and of the magnetic sheet metal cores to guide the flux, the latter not shown. The magnetic field has a preponderant progressive wave component. This progressive wave of the magnetic field moves toward the top or the bottom, depending on the order of succession of the phase R, S and T.

It is known that a progressive magnetic field creates a vortex $\vec{W}$ with a tangential component $W_\theta$ (the only one of interest, because in principle $W_\rho$ and $W_\zeta$ are zero) having the same sign throughout the bath of molten metal. The result is a turbulent motion 7 (FIG. 2) and the appearance of a bulge or a depression on the surface of the bath, depending on the succession of the R, S and T phases. There will be a bulge when the magnetic field progresses downward and a depression when the magnetic field progresses upward.

It is also known to compensate at least partially the effects causing the turbulent motions with the aid of two power sources of different frequency, as described in French Pat. No. 767,249, for example. These currents having different frequencies may either circulate in different windings, or the power supply of certain parts of the winding of the furnace may be controlled independently by means of the two sources.

It is the object of the invention to strongly reduce the height of the bulge or the depth of the depression on the surface of the bath caused by the induced electromagnetic forces, but without requiring two sources of differing frequency.

According to the invention, an induction furnace comprising a crucible with a vertical axis, containing a bath of molten metal, surrounded by polyphase windings of several coils aligned along the crucible and arrangements of certain parts of the windings capable of causing movements in the metal bath, characterized in that the coils of polyphasic windings are arranged in two groups:

n coils on the upper part of the crucible and n' coils on the lower part of the crucible, such that the upper coils are supplied by a polyphaseic system having n voltages $\vec{U}_l \ldots \vec{U}_n$ presenting a negligible inverse component $U_i$ with respect to a direct component $\vec{U}_d$ (field progressing upward) and a homopolar component $\vec{U}_o$, the $U_o/U_d$ ratio being chosen so that the tangential components of the vortices generated by the homopolar component on the one hand and the direct component on the other hand, are of opposing signs and of amplitudes of the same order or magnitude and preferably of equal amplitudes, more or less in the upper part of the bath. Simultaneously, the lower n' coils are supplied by a polyphasic system of n' voltages $\vec{U}_l' \ldots \vec{U}_n'$, presenting a direct component $\vec{U}_d'$ negligible with respect to an inverse component $\vec{U}_l'$ (field progressing downward) and a homopolar component $\vec{U}_o'$, the $U_o'/U_l'$ ratio being chosen so that the tangential components of the vortices generated by the homopolar component on the one hand and the inverse component on the other hand, having opposing signs and amplitudes of the same order of magnitude, preferably equal, more or less in the lower part of the bath.

Such a design of an induction furnace results in a combination of a stationary filed and a progressive field which act to reduce the vortices to a relatively low value due to the compensation of the effect of the two fields, with the consequence that the bulge of the surface of the bath is reduced with respect to the bulge produced by a single phase coil of the same power or by a polyphasic coil with a progressive field of the same power.

The invention will be explained hereinafter with respect to certain variations of an example of embodiment having reference to FIGS. 7 to 18 of the drawing attached hereto.

Figure 7:
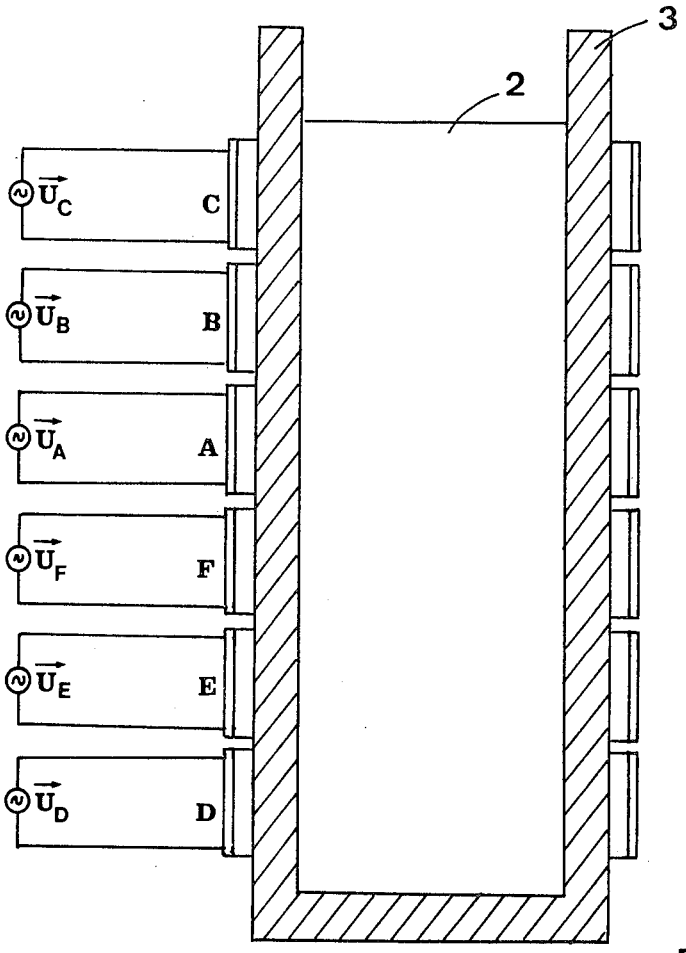
FIG. 7 is a cross section of the induction furnace in accordance with one embodiment of the invention.
Figure 8:
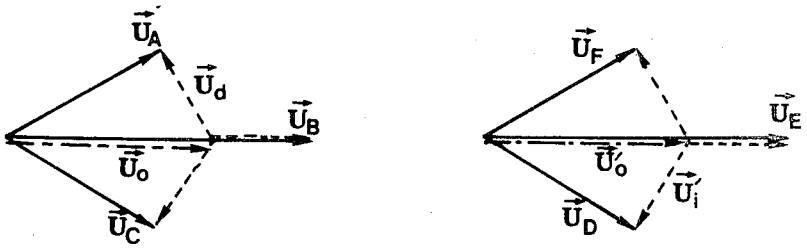
FIGS. 8–11 are examples of vector diagrams.
Figure 9:
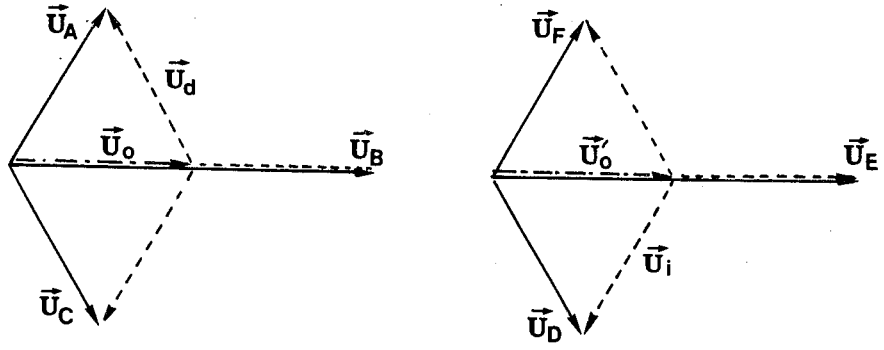
Figure 10:
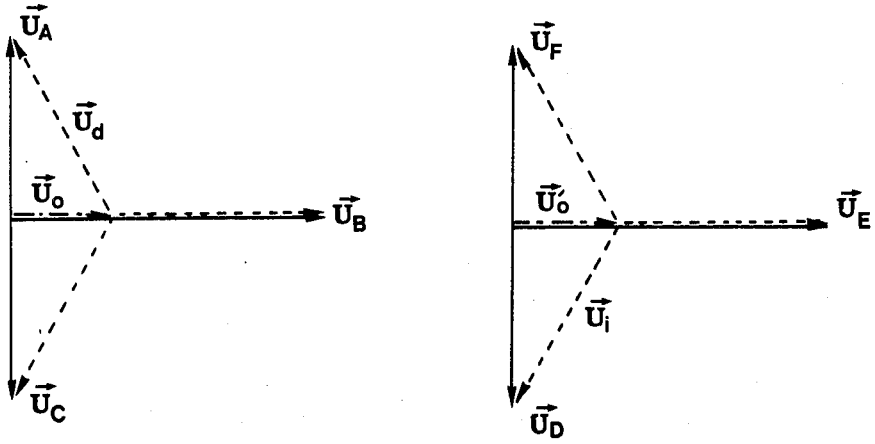

According to a first embodiment of the invention, the coil of the induction furnace consists of six windings designated A, B, C, D, E, F. Among these, A, B and C are the upper windings and D, E, F are the lower windings (FIG. 7). The respective number of turns may be equal between them or it may be different.

The three upper windings A, B and C are connected with a system of three supply voltages $\vec{U}_A$, $\vec{U}_B$ and $\vec{U}_C$ having direct components $\vec{U}_d$, inverse components $\vec{U}_i$ and homopolar components $\vec{U}_o$, defined as follows hereinafter for the system $\vec{U}_A$, $\vec{U}_B$, $\vec{U}_C$ (FIG. 8) and in the generalized case for a polyphasic system $\vec{U}_K=\vec{U}_l, \vec{U}_2 \ldots \vec{U}_n$.

(a) The direct component (generating a filed progressing upward):

$$\vec{U}_d = \frac{1}{n}\sum_{k=1}^{n} \alpha^{(k-1)}\vec{U}_k;\ \alpha = \exp\left(\frac{2\pi i}{n}\right),$$

$$\text{for } n = 3:\ \vec{U}_d = \tfrac{1}{3}(\vec{U}_A + \alpha\vec{U}_B + \alpha^2\vec{U}_C)$$

(b) the inverse component (generating a field progressing downward):

$$\vec{U}_i = \frac{1}{n}\sum_{k=1}^{n} \alpha^{(1-k)}\vec{U}_k;$$

$$\text{for } n = 3:\ \vec{U}_i = \tfrac{1}{3}(\vec{U}_A + \alpha^{-1}\vec{U}_B + \alpha^{-2}\vec{U}_C)$$

(c) the homopolar compartment (generating a stationary field):

$$\vec{U}_o = \frac{1}{n}\sum_{k=1}^{n} \alpha^{(1-k)}\vec{U}_k$$

$$\text{for } n = 3:\ \vec{U}_o = \tfrac{1}{3}(\vec{U}_A + \vec{U}_B + \vec{U}_C)$$

According to the invention, $\vec{U}_i$ is negligible with respect to the direct component $\vec{U}_d$ and the homopolar component $\vec{U}_o$, and the $U_o/U_d$ ratio between the homopolar and direct components is chosen so that the tangential components $W_{\theta o}$ and $W_{\theta d}$ of the vortices $W_o$ and $W_d$ generated by the stationary field $\vec{U}_o$ on the one hand and the progressive field of the direct component $\vec{U}_d$ on the other, during the supply of the coils by triphasic voltages, are of opposing signs and of equal amplitudes (or at least of the same order of magnitude) in the upper part of the bath, i.e.

$$W_{\theta o} = W_{\theta d}$$

In this case, anything taking place in the upper part of the bath occurs as if there were compensation between two effects:

(a) a first effect due to the homopolar component $\vec{U}_o$ similar to that produced by a single phase coil with a stationary field, i.e. in particular the appearance of a dome on the upper surface of the bath (b) a second effect due to the direct component $\vec{U}_d$, similar to that produced by a triphasic coil with a field progressing upward, i.e. in particular the appearance of a depression on the upper surface of the bath.

The $U_o/U_d$ ratio is chosen so that the two effects compensate each other.

These conditions may be satisfied, for example when the polyphasic grid comprises three voltages offset by electrical angles equal to or less than 90°, each with respect to the next one, so as to form a group of three vectors in the same semiplane, the external vectors of the center (FIG. 8 and FIG. 9):

Still in keeping with the first embodiment of the invention, the three lower windings D, E and F are connected with three supply voltages $\vec{U}_D$, $\vec{U}_E$ and $\vec{U}_F$, the direct components $\vec{U}_d'$, inverse components $\vec{U}_l'$ and homoplanar components $\vec{U}_o'$ of which satisfy the following three conditions (FIG. 8):

(a) the direct component $\vec{U}_d'$ is negligible with respect to the inverse component $\vec{U}_l'$, the downwardly progressing field is thus predominant.

(b) the homopolar component $\vec{U}_o'$ is not negligible with respect to the inverse component $\vec{U}_l'$ (c) the ratio $U_o'/U_l'$ of the amplitudes of the homopolar and inverse components is chosen so that the tangential components $W_{\theta o}$ and $W_{\theta i}'$ of the votices $\vec{W}_o'$ and $\vec{W}_l'$ generated by the coils supplied by $\vec{U}_o'$ on the one hand, and the coils supplied by the triphasic voltages associated with the inverse component $\vec{U}_l'$, be of opposing signs and of equal amplitudes (or at least of the same order of magnitude in the lower part of the bath), i.e.

$$W_{0o}' = W_{0L}'.$$

In this case, the lower half of the bath is the site of compensation between the same two effects as in the upper half, mutatis mutandis.

In the entire molten bath, the turbulent motion caused by the existence of the vortex $\vec{W}$ is thus, with a constant heating power, considerably reduced with respect to what it would be in the case of a single phase coil, together with all of the advantages derived from the absence of the bulge or at least from its reduced height.

A second embodiment of the invention (FIG. 9) consists of a special case of the first embodiment in which the coils occupy symmetrical positions with respect to a plane perpendicular to the axis of the crucible, said plane separating the upper part from the lower part, and pairs of coils are supplied by voltages of the same phase, such that:

(a) $\vec{U}_A$ and $\vec{U}_F$ have the same phase (with equal or different amplitudes)

(b) $\vec{U}_B$ and $\vec{U}_E$ have the same phase and are offset in phase by 60° with respect to $\vec{U}_A$ (c) $\vec{U}_C$ and $\vec{U}_D$ have the same phase and are offset in phase by 60° with respect to $\vec{U}_B$ and by 120° with respect to $\vec{U}_A$ (d) the respective amplitudes of the voltages are chosen so as to satisfy in the best possible manner the following equations:

$$W_{\theta o}=W_{\theta d} \quad \text{and} \quad W_{\theta o}'=W_{\theta o}'$$

In this case, it is very easy to connect the six coils with a triphasic supply grid.

A third embodiment of the invention (FIG. 10) consists of another special case of the first embodiment, in which (a) $\vec{U}_A$ and $\vec{U}_F$ have the same phase (with equal or different amplitudes)

(b) $\vec{U}_B$ and $\vec{U}_E$ have the same phase and are offset in phase by 90° with respect to $\vec{U}_A$ (c) $\vec{U}_C$ and $\vec{U}_D$ have the same phase and are offset by 180° with respect to $\vec{U}_B$ and by 120° with respect to $\vec{U}_A$ (d) the respective amplitudes of the voltages are chosen so that they satisfy the following equations in the best possible manner:

$$W_{\theta o}=W_{\theta d} \quad \text{and} \quad W_{\theta o}'=-W_{\theta i}'$$

In this case it is very easy to connect the six coils to a biphasic supply grid.

A fourth embodiment of the invention is obtained by eliminating in the three first embodiments one coil from the halves, for example the coils A and F (FIG. 7). Even providing the conditions of compensation in this fourth embodiment can be accomplished imperfectly only, said compensation is sufficient to obtain the effect desired, i.e. a substantial reduction of the dome. The arrangement of the windings of this fourth embodiment and their power supply are shown in FIG. 12. The voltages $\vec{U}_P$ and $\vec{U}_Q$ supply the windings P and Q in the upper part of the furnace are offset in phase as shown by the series of vector diagrams, FIG. 11. The same is true for the voltages $\vec{U}_P'$ and $\vec{U}_Q'$ supplying the windings P' and Q' in the lower part. In each of the parts of the furnace, two effects are superposed:

(a) the effect due to the homopolar component which in the upper part of the bath causes agitation toward the bottom at the periphery and toward the top in the axis, and in the lower part agitation toward the top at the periphery and downward in the axis.

Figure 11:
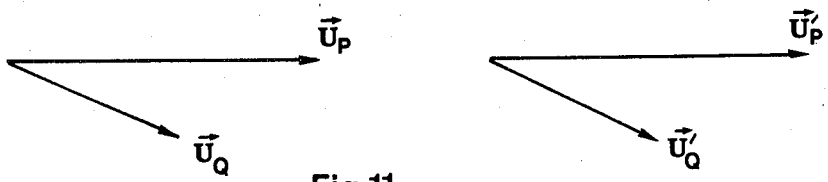
Figure 12:
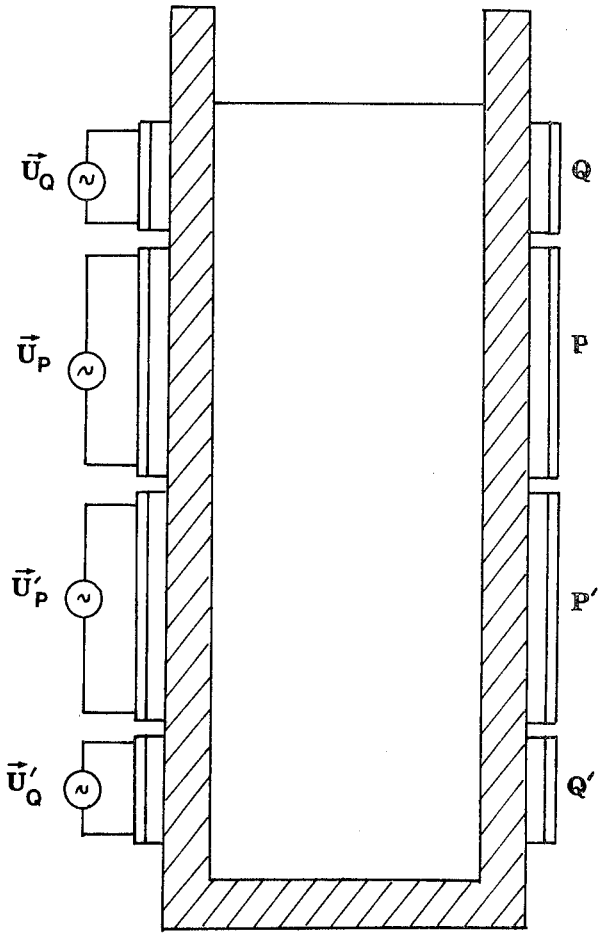
FIGS. 12–15 are electrical circuit diagrams for supplying the windings of the furnace.

(b) the effect due to the progressive component of the magnetic field caused by the phase offset between the voltages $\vec{U}_P$ and $\vec{U}_Q$ on the one hand and $\vec{U}_P'$ and $\vec{U}_Q'$ on the other hand (FIG. 11). In the upper part, this progressive component is directed upward, and in the lower part of the bath it is directed downward. In fact, $\vec{U}_Q$ which supplies the upper winding Q is retarded with respect to $\vec{U}_P$ and causes agitation upward at the periphery of the bath and downward in the axis. On the other hand, $\vec{U}_Q'$ which supplies the lower winding Q', is retarded with respect to $\vec{U}_P'$ and causes agitation downward at the periphery and upward in the axis of the bath.

By means of a judicious choice of the phase offset between the voltages $\vec{U}_P$ and $\vec{U}_Q$ on the one hand, and $\vec{U}_P'$ and $\vec{U}_Q'$ on the other, and of the ratio between their amplitudes, by taking into consideration the number of turns of each winding, it is possible to compensate the two effects to a very high degree and to reduce same to a harmless value of stirring in the molten bath.

FIGS. 13, 14, 15 and 16 display other circuit diagrams for the supply of power to the windings. In these diagrams, each winding is connected in parallel by way of a tuning condenser 8 to compensate for reactive power.

Figure 13:
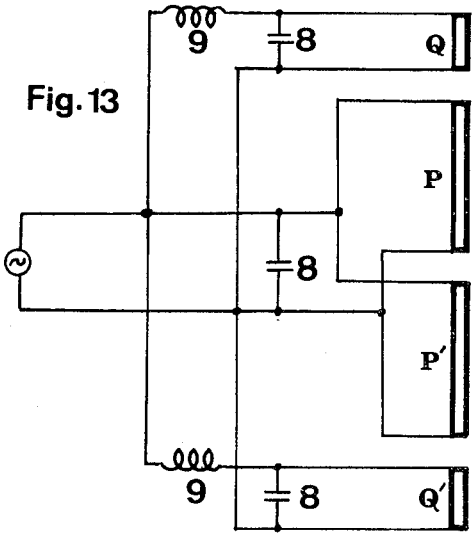
Figure 14:
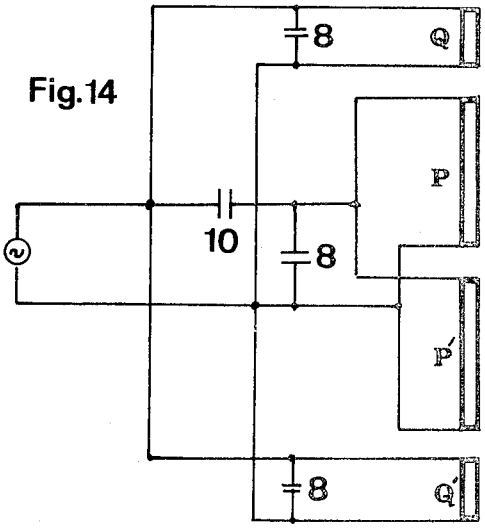
Figure 15:
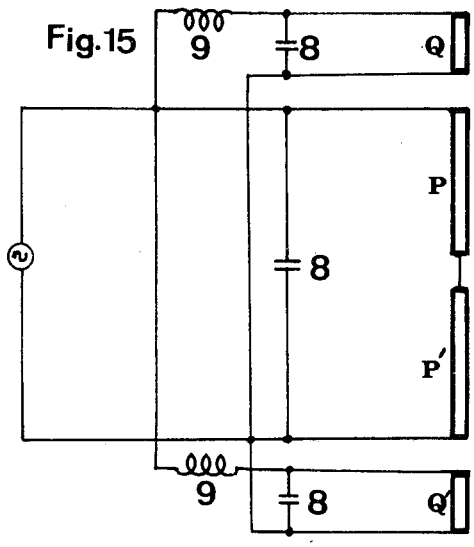
Figure 16:
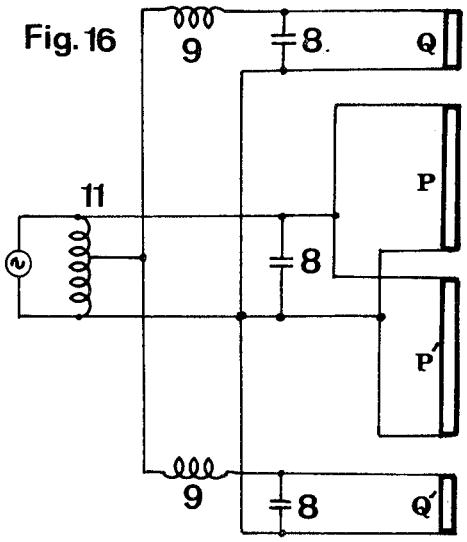
FIGS. 16–18 are diagrams of physical values as a function of the height of the bath.

The diagrams differ in the manner in which the phases are offset between the voltages $\vec{U}_P$, $\vec{U}_Q$, $\vec{U}_P'$ and $\vec{U}_Q'$, either by means of self-induction coils 9 as in the case of FIGS. 13, 15 and 16, or by means of condensers 10 as in the case of FIG. 14. Because according to the vector diagram (FIG. 11), the voltages $\vec{U}_P$ and $\vec{U}_P'$ are in phase, they may be taken off the terminals of the same power source to supply the coils P and P' either in series (FIG. 16) or in parallel (FIGS. 13 to 15). According to the diagram of FIG. 16, the voltage supplying the end windings Q and Q' is taken off an autotransformer at 11. This makes it possible to control the amplitude of the voltages $\vec{U}_Q$ and $\vec{U}_Q'$ with respect to $\vec{U}_P$ and $\vec{U}_P'$ in order to optimize the compensation of the turbulent effects. Experiments have shown that with a circuit having the advantage of amplitude control as indicated in FIG. 16, it is possible to neutralize very well the harmful effects of the homopolar component by the effects of the progressive component at various heights of the bath.

Figure 17:
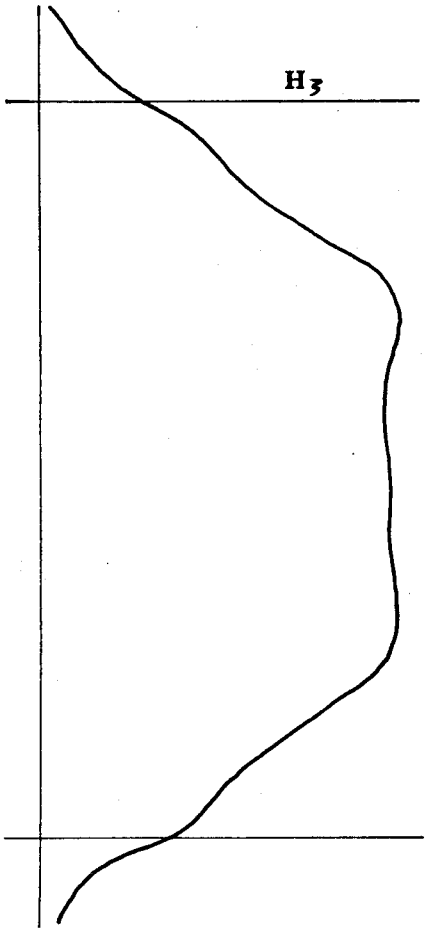
Figure 18:
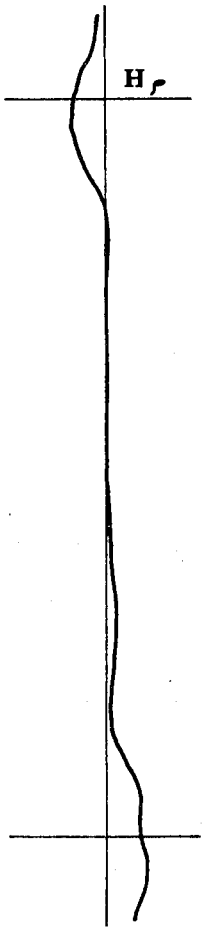
Figure 19:
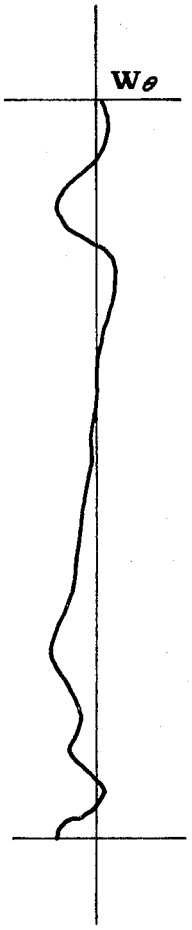

The diagrams of the FIGS. 17 to 19 are constructed on the same scale as FIGS. 4 to 6 and are comparable to them. This comparison shows that for two equivalent homopolar fields represented by the diagrams of the axial components H (FIGS. 4 and 17), the tangential component $W_\theta$ of the vortex (FIG. 19) of the solution represented in FIG. 12 is in effect much weaker than the tangential component $W_\theta$ (FIG. 6) of the uncompensated solution of FIG. 3.

Other embodiments may still be obtained beginning with the first embodiment, by changing the number of phases from 3 to another number N. In this case, there are in each half of the furnace N coils connected to a system of N alternating power sources with predetermined phases and amplitudes, the direct, inverse and homopolar components of which satisfy the conditions defined hereinabove for the case of the first embodiment.

We claim:

1. Induction furnace comprising a crucible with a vertical axis, containing a bath of molten metal, surrounded by a polyphase winding of a plurality of coils aligned along the crucible and comprising arrangements of certain parts of the windings capable of causing movements in the metal bath, characterized by that the coils of the polyphase winding are arranged in two groups, with n coils at the upper part of the crucible and n' coils at the lower part of the crucible, by that the upper n coils are supplied by a polyphase system of n voltages $\vec{U}_l \ldots \vec{U}_n$, having an inverse component $\vec{U}_i$ negligible with respect to a direct component $\vec{U}_d$ (upward progressing field) and a homopolar component $\vec{U}_o$, the ratio of $U_o/U_d$ being chosen so that the tangential components of the vortices generated by the homopolar component on the one hand, and direct component on the other hand, have opposing signs and amplitudes of the same order of magnitude, preferably of equal magnitude, at least in the upper portion of the bath, by that simultaneously, the n' coils of the lower part are supplied by a polyphase system of n' voltages $U_l' \ldots U_n''$, having a direct component $\vec{U}_d'$ negligible with respect to an inverse component $U_l'$ (downward progressing field) and a homopolar component $\vec{U}_o'$, the ratio of $\vec{U}_o'/\vec{U}_l'$ being chosen so that the tangential components of the vortices generated by the homopolar component on the one hand, and the inverse component on the other hand, have opposing signs and amplitudes of the same order of magnitude, preferably of equal magnitude, at least in the lower part of the bath.

2. Induction furnace according to claim 1, characterized by that the crucible is surrounded by three upper coils and three lower coils, that the polyphase voltage systems comprise three voltages offset by electrical angles equal to or less than 90° with respect to one another in sequence, so as to form a group of three vectors in the same semiplane, with the two external vectors being appreciably shorter than the center vector.

3. Induction furnace according to claim 1, characterized by that the crucible is surrounded by two upper coils and two lower coils and that only two phases are used in each of the polyphase voltage systems, whether two-phase or tri-phase.

4. Induction furnace according to claims 1, 2 or 3 characterized by that in the case where the coils occupy positions symmetrical with respect to a plane perpendicular to the axis of the crucible separating the upper part from the lower part, they are supplied by voltages of the same phase.

5. Induction furnace according to claim 4 characterized by that the amplitude of the voltages supplying the coils on the upper and lower ends may be controlled with respect to the voltages supplying the median coils.

6. Induction furnace according to any one of claims 1–3, characterized by that the amplitude of the voltages supplying the coils on the upper and lower ends may be controlled with respect to the voltages supplying the median coils.

7. In an induction furnace comprising a crucible with a verticle axis and containing a bath of molten metal, a method of reducing surface purtubations of said molten metal while inductively stirring same comprising the steps of:

surrounding said crucible with two groups of a polyphase winding of a plurality of coils aligned along the crucible, the first group of n coils positioned at an upper part of the crucible, the second group of n' coils positioned at a lower part of the crucible, supplying the upper n coils with a polyphase system of n voltages $\vec{U}_l \ldots \vec{U}_n$, having an inverse component $\vec{U}_i$ negligible with respect to a direct component $\vec{U}_d$ (upward progressing field) and a homopolar component $\vec{U}_o$, selecting the ratio of $U_o/U_d$ so that the tangential components of the vortices, at least in the upper portion of the bath, generated by the homopolar component and the direct component have opposing signs and amplitudes of the same order of magnitude, supplying the lower n' coils with a polyphase system of n' voltages $\vec{U}_l' \ldots \vec{U}_{n'}'$, having a direct component $\vec{U}_d'$ negligible with respect to an inverse component $\vec{U}_l'$ (downward progressing field) and a homopolar component $\vec{U}_o'$, selecting the ratio of $U_{o'}/U_l'$ so that the tangential components of the vortices, at least in the lower part of the bath, generated by the homopolar component and the inverse component have opposing signs and amplitudes of the same order of magnitude.

8. A method as recited in claim 7, wherein the ratio $U_o/U_d$ is selected such that the components of the vortices generated by the homopolar and direct components having substantially equal amplitudes.

9. A method as recited in claim 7, wherein the ratio $U_o'/U_l'$ is selected such that the components of the vortices generated by the homopolar and direct components have substantially equal amplitudes.

10. A method as recited in claim 7, wherein the crucible is surrounded by three upper coils and three lower coils, the polyphase voltage system is selected to have three voltages offset by electrical angles equal to or less than 90° with respect to one another in sequence, so as to form a group of three vectors in the same semiplane, with the two external vectors being appreciably shorter than the center vector.

11. A method as recited in claim 7, wherein the crucible is surrounded by two upper coils and two lower coils and only two phases are selected in each of the polyphase voltage systems, whether two-phase or tri-phase.

12. A method as recited in any one of claims 7–11, wherein said surrounding step includes positioning the two groups in a symmetrical fashion with respect to a plane perpendicular to the axis of the crucible and separating the upper part from the lower part of the crucible, and said first and second supplying steps comprise supplying voltages of the same phase.

13. A method as recited in claim 12 further comprising the step of controlling the amplitude of the voltages supplying the coils positioned on the upper and lower parts of said crucible with respect to the voltages supplying coils positioned proximate the center of said crucible.

14. A method as recited in any one of claims 7–11 further comprising the step of controlling the amplitude of the voltages supplying the coils positioned on the upper and lower parts of said crucible with respect to the voltages supplying coils positioned proximate the center of said crucible.

* * * * *